United States Patent [19]

Ruiz

[11] Patent Number: 4,813,882

[45] Date of Patent: Mar. 21, 1989

[54] MOUNTING BASE APPARATUS

[76] Inventor: Jose M. Ruiz, 1719 Laredo, Laredo, Tex. 78040

[21] Appl. No.: 180,717

[22] Filed: Apr. 4, 1988

Related U.S. Application Data

[63] Continuation of Ser. No. 106,944, Oct. 15, 1987, abandoned, which is a continuation of Ser. No. 809,561, Dec. 16, 1985, abandoned.

[51] Int. Cl.[4] ..... H01R 13/631

[52] U.S. Cl. ..... 439/101

[58] Field of Search ..... 439/101, 514, 515

[56] References Cited

U.S. PATENT DOCUMENTS

| | | | |
|---|---|---|---|
| 2,740,922 | 4/1956 | Hilton | 439/415 |
| 2,850,714 | 9/1958 | Pace | 439/181 |
| 4,623,209 | 11/1986 | Mangone | 439/181 |

FOREIGN PATENT DOCUMENTS

| | | | |
|---|---|---|---|
| 1395832 | 5/1975 | United Kingdom | 439/181 |

*Primary Examiner*—Joseph H. McGlynn

*Attorney, Agent, or Firm*—Dodge, Bush & Moseley

[57] ABSTRACT

A mounting base apparatus for an electrical power measuring device such as a watt-hour meter, that is especially adapted for use in residential applications and providing a lightning arrester for the mounted meter. The apparatus includes one piece molded plastic a one piece molded plastic base structure including a circular base having a forwardly extending tubular side wall for forming a partially enclosed cavity. The tubular side wall terminates in an external flange forming a substantially planar circular surface having a concentric opening for receiving the watt-hour meter. Mounted on the base within a partially enclosed cavity formed by the side wall and base are a plurality of electrical terminals. The terminals receive a corresponding plurality of blade terminals on the watt meter to electrically connect the watt-hour meter. Mounted within the cavity is an electrical conductor or shunt gapped sufficiently from the terminals to prevent electrical arcing through the conduit at normal voltages while providing grounding safety protection against undesired power surges caused by lightning and the like.

6 Claims, 1 Drawing Sheet

FIG. 1
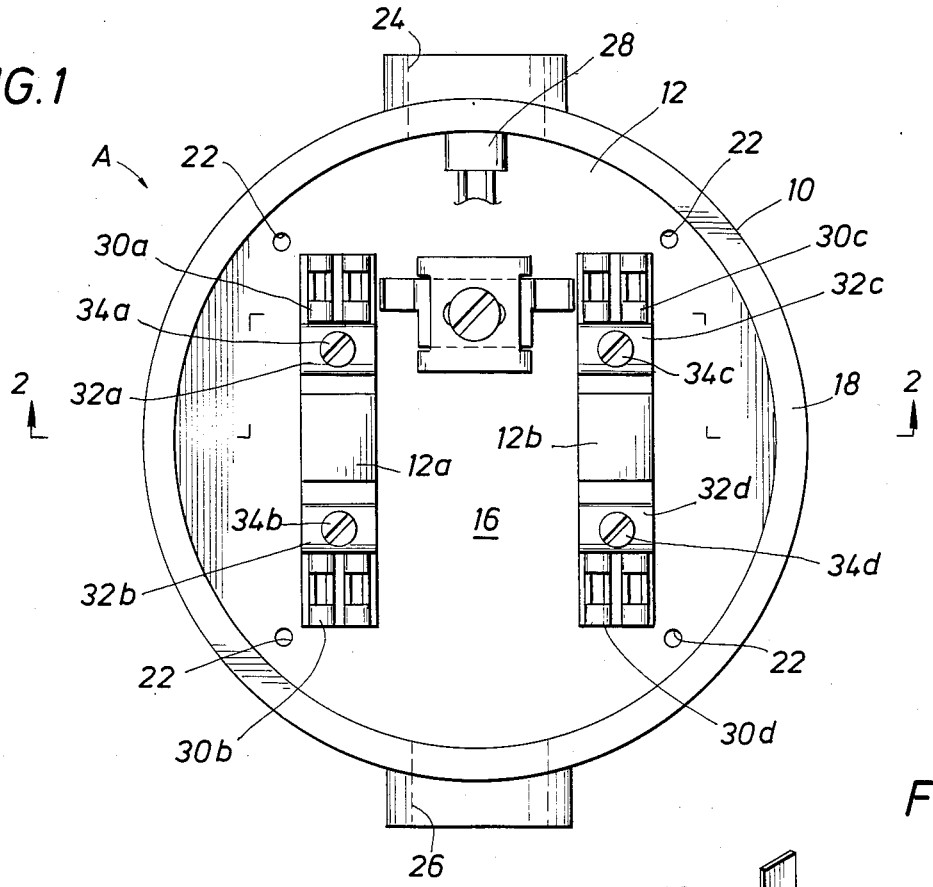
FIG. 3
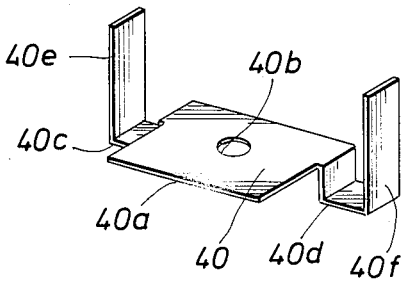
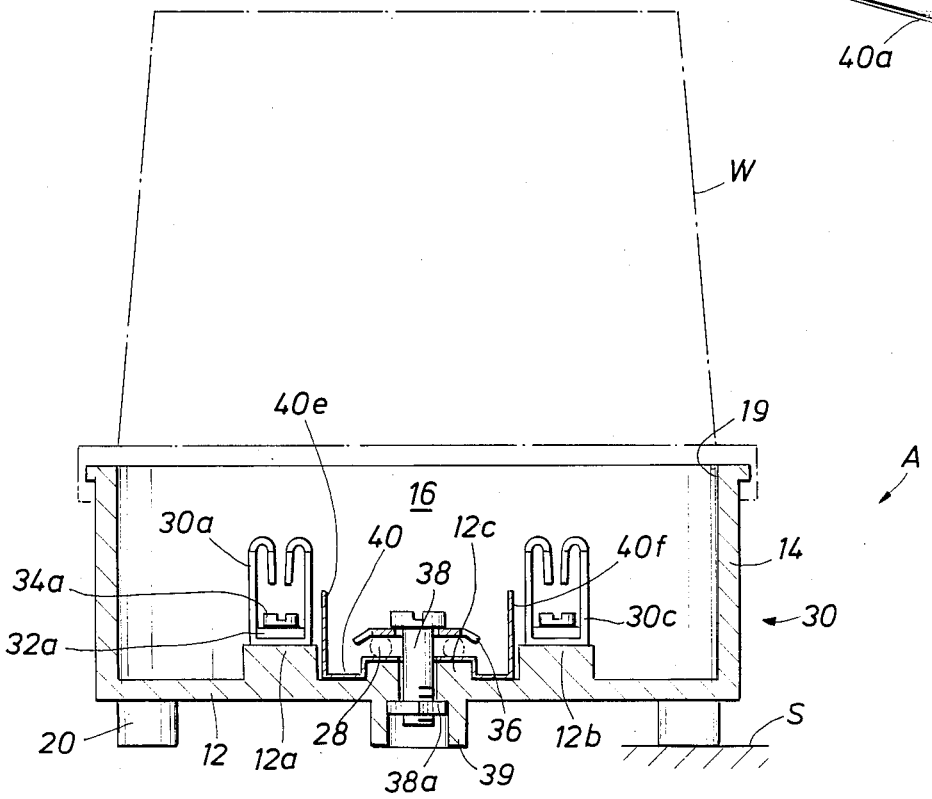
FIG. 2

MOUNTING BASE APPARATUS

This application is a continuation of application Ser. No. 106,944, filed 10/15/87 abandoned which is continuation of Ser. No. 809,561, filed 12/16/85, abandoned.

BACKGROUND OF THE INVENTION

1. Field of the Invention

This invention relates to the field of a mounting base apparatus and more particularly to a mounting base apparatus for an electrical power measuring device.

2. Description of the Prior Art

Electrical energy measurement devices are extensively employed to measure electrical power consumption by specific customers or users. Typically, watt-hour meters are used for measuring and indicating electrical power consumption in kilowatt-hours by residential customers. The watt-hour meters are usually of the induction type having a horizontal rotating disk providing a high degrees of reliability and accuracy. Such meters are commercially available from a number of suppliers at reasonable costs and are capable of highly reliable outdoor operation under extremes of temperature and other widely varying ambient operating conditions. The widespread use of such meters is also furthered by the ease with which it can be installed.

The conventional method of determining customer use of electrical energy is to locate a kilowatt-hour meter at the electrical power entry point of the customer's electrical network. Normally such meters are located exteriorly of any building or structure so that they may be read without need for access to the customers building or residence. Numerous systems have been disclosed in the prior art for measuring the usage or power consumption of electricity by a particular customer. Examples of such systems include the following U.S. patents:

| U.S. Pat. No. | Patentee |
|---|---|
| 4,378,524 | Steinmuller |
| 4,291,375 | Wolf |
| 4,253,151 | Bouve |
| 4,250,552 | Elms |
| 4,077,061 | Johnston et al. |
| 3,947,762 | Hug |
| 3,836,852 | Ross |
| 3,764,908 | Elms |
| 3,760,273 | Burkett et al. |
| 4,415,853 | Fisher |
| 4,399,510 | Hicks |
| 4,360,879 | Cameron |
| 4,351,028 | Peddie et al. |
| 4,345,311 | Fielden |
| 4,261,037 | Hicks |
| 4,283,772 | Johnston |
| 4,236,217 | Kennedy |
| 4,315,212 | Gamoh |
| 4,182,983 | Heinrich et al. |
| 4,120,031 | Kincheloe et al. |

Some systems, such as disclosed in Gilkerson et al. U.S. Pat. No. 4,207,557 disclosed the electrical usage in quantity of power consumed as well as directly in dollar cost.

While most such measurement systems are intended to determine or measure total electrical power usage by a particular user, a number of such devices are intended to measure power consumption of a specific appliance or electrical load. Examples of such measurement systems or meters are disclosed in U.S. Pat. Nos. 4,010,417 (to Ionescu) and 4,314,201 (to Marro et al) as well as the article entitled "Power Meter—its an energy saver and troubleshooter" published in the March, 1976 issue of *Popular Science* at page 162. See also U.S. Pat. No. 4,291,376 to McCahill.

As noted previously, the most common watt-hour meter is the induction type that is normally installed for the residential user. Examples of such meters are disclosed in U.S. Pat. Nos. 4,257,004; 4,368,424; and 4,413,230, all naming Robert C. Miller as inventor. Such meters are designed with a housing having four knife blade electrical terminals for ease of mating with corresponding plurality of socket or base terminals positioned in the conventional meter-mounting box. The plug-in meter is then secured to the metal meter-mounting housing with a conventional ring-like metal peripheral clamp that is sealed shut with a soft metal clamp to prevent tampering, unauthorized adjustments or removal of the meter. Because a metallic mounting base is normally used, a lightening arrester is normally built into the meter itself for protection. The arrester is then electrically connected to the grounding strap.

The above mentioned patents are hereby incorporated by this specific reference for all purposes as if fully set forth herein.

SUMMARY OF THE INVENTION

The present invention relates to the field of a mounting base apparatus for an electrical power meter. In particular an electrically insulated one piece molded plastic mounting box or base structure is disclosed. The base structure positions and mounts the electrical socket terminals for electrically connecting the meter with the power supply and customer's electrical network in the usual manner. The base apparatus is provided with a metal safety conductor or shunt to protect the meter in the event of an excess voltage surge in the power supply such as caused by lightning or a short circuit. The shunt is provided with an air gap to enable operation at normal voltage, but which arcs over at the potentially damaging higher voltage electrical power to protect the meter and user's electrical network.

BRIEF DESCRIPTION OF THE DRAWING

FIG. 1 is a side view of the mounting box apparatus of the present invention;

FIG. 2 is a view taken along line 2—2 of FIG. 1; and

FIG. 3 is a perspective view of the electrical safety conductor of the present invention.

DESCRIPTION OF THE PREFERRED EMBODIMENT

The mounting box apparatus of the present invention, generally designated A in FIGS. 1 and 2, is used to operably mount or support an electrical power measuring device, such as watt-hour meter W. While the preferred and illustrated embodiment is for a watt-hour meter W, it will be understood by one skilled in the art that the illustrated apparatus A may be modified within the scope of the present invention to operably mount any suitable electrical power measuring device.

The mounting box apparatus A includes a one piece molded plastic base structure, generally designated 10, that is preferably formed with a circular or disk shaped back 12. To position the rotating disk of the meter W horizontally, the back 12 is normally mounted in the vertical position illustrated. An integral tubular side wall 14 extends forwardly and horizontally from the outer peripheral edge of the base 12 for forming a partially enclosed cavity 16 in which the electrical components are disposed in a manner to be described more fully hereinafter. The circular side wall 14 terminates in a circular support and positioning flange 18 which assists in mounting the meter W to the apparatus A. The outwardly extending flange 18 forms a concentric internal opening 19 to only partially enclose the cavity 16 and thereby provide ready access to the cavity 16 for installation purposes. Preferably, the base structure 10 is molded of a non-conducting composite material such as polyethylen having a fiberglass reinforcing filler for providing strength and rigidity. Such material is easily worked in the field with hand tools and will receive and hold self-tapping screws.

As best illustrated in FIG. 2, a plurality of spaces or mounting legs 20 extend rearwardly from the back 12 for positioning the base structure 10 relative to a suitable support structure S. Each of the plurality of mounting legs 20 has a central opening 22 through which a conventional attachment screw or nail (not illustrated) may be positioned for connecting or securing the base structure 10 to the support structure S in the usual manner. In normal practice, only the most convenient and not all of the plurality of the openings 22 will be used in securing or mounting the base structure 10.

Formed in the side wall 14 are a plurality of threaded openings 24, 26 for enabling passage of electrical conductor wires into or out of the cavity in the usual manner. The openings 24 and 26 are threaded in the standard manner for securing conventional protective tubular electrical conduits (not illustrated) in which the wiring is placed for protection. Preferably, the opening 24 provides an inlet for the power supply wires 28 to the cavity 16 while the opening 26 serves as an outlet for the wire (not illustrated) connected to the user's or customer's electrical consumption network. If desired, additional openings may be provided for convenience and filled with threaded plugs (not illustrated) if not used.

Disposed in the cavity 16 in a prearranged pattern is a plurality of conventional electrical socket terminals 30 for receiving a corresponding plurality of conventional knife blade electrical terminals (not illustrated) carried by the watt-hour meter W. For ease of assembly, the knife blade terminals are simply inserted through opening 19 into the socket or base terminals 30 to electrically connect the meter W when installing the watt-hour meter W on the base structure 10. The socket terminals 30 are provided with sufficient flexure or resilience to ensure proper electrical contact with knife blade terminals during operation of the meter W. A suitable flange peripheral clamp (not illustrated) secures the watt-hour meter W with the base structure 10 in the conventional manner.

As illustrated in FIG. 2, the back 12 is provided or molded with a pair of parallel terminal mounting vertically extending ribs 12*a* and 12*b* providing thickened or strengthened sections. Preferably, a pair of electrical conducting terminals 30*a* and 30*b* are disposed on rib 12*a* while a second pair of terminals 30*c* and 30*d* are mounted on the second rib 12*b*. Self-tapping screws (not illustrated) secure the electrical conducting terminals 30*a*, 30*b*, 30*c* and 30*d* to the ribs 12*a* and 12*b* of the base structure 10. Each of the terminals 30*a*, 30*b*, 30*c* and 30*d* includes a wire clamp 32*a*, 32*b*, 32*c* and 32*d*, respectively, for securing an uninsulated end portion of a wire 28 to establish electrical conduit for the associated terminal in the known manner. Conventional clamp securing screws 34*a*, 34*b*, 34*c* and 34*d* mounted with terminals 30*a*, 30*b*, 30*c* and 30*d*, respectively, releasably secure the associated clamp 32 with the conductor wires 28 for establishing and maintaining electrical continuity.

Disposed between electrical inlet terminals 30*a* and 30*c* is a wire securing clamp 36 that is operably secured by the threaded attachment screw 38 and nut 38*a* contained in vertical center line located hollow mounting leg 39. The clamp 36 secures the inlet wire 28 to the base structure 10 to protect terminals 30*a* and 30*c* from undesired forces transmitted through input wire 28 which could result in undesired electrical disconnection of the meter W. As will be explained, the attachment screw 38 and nut 38*a* may also serve as a grounding terminal if desired.

The mounting leg 39 is disposed adjacent and opposite a thickened internal or forwardly extending portion 12*c* of the base structure 12 which provides a mounting base for the wire securing clamp 36. Located between the clamped wire 28 and the mount 12*c* is a safety metal electrical safety conductor or shunt 40. The shunt 40 serves as an external lightening arrester for the watt-hour meter W eliminating the need to provide expensive internal protection in the meter W.

As best illustrated in FIG. 3, the shunt 40 has a central base portion 40*a* having an opening 40*b* through which screw 38 extends to hold the shunt 40 in operable position within cavity 16. The screw and nut 38*a* may be used to electrically connected with a suitable grounding strap (not illustrated) if so desired. The shunt 40 has a pair of oppositely extending arms 40*c* and 40*d* which fit tightly about the mount 12*c* and back 12 until adjacent the ribs 12*a* and 12*b* mounting the inlet terminals 30*a* and 30*c*, respectively. The arms 40*c* and 40*d* have forwardly extending portions 40*e* and 40*f*, respectively, which are disposed adjacent electrically conductive terminals 30*a* and 30*c*, respectively, but are gapped or positioned a predetermined distance from the terminals 30*a* and 30*c* (FIG. 2) to provide an electrically insulating space or air gap at normal operating voltage for the watt-hour meter W. In the event the supply of electrical power to the watt-hour meter W exceeds the substantially normal operating voltage of the watt-hour meter W, such as a voltage surge caused by lightening or by a malfunction, the shunt 40 will protect the meter W. The excessive electrical voltage will arc or short across the gap between the terminal 30*a* and arm 40*e* or arm portion 40*f* and terminal 30*c* to create a shunt circuit through conductor 40 and then pass to ground through the grounding wire attached by threaded bolt 38 and which thereby serves as a grounding terminal between the electrical power inlet terminals 30*a* and 30*c* to protect the watt-hour meter W from the potentially dangerous voltage surge. While two insulating air gaps have been illustrated, it will be understood by one skilled in the art that only a single insulating air gap to be bridged by the excess voltage may be provided depending on the inlet wiring arrangement. By shunting between the input terminals 30*a* and 30*c* with this otherwise passive overload protector both the watt-hour meter W and the customer electrical network are protected from voltage surges in the electrical power supply. Due to the absence of moving parts, the shunt 42 is an extremely simple, relatively inexpensive and reliable means of over voltage protection.

USE AND OPERATION OF THE PRESENT INVENTION

In the use and operation of the present invention, the base structure 10 is mounted to the support structure S using mounting opening 22. Suitable conduits are attached to opening 24 and 26 and insulated wiring 28 installed. The uninsulated ends of the wiring is then attached to the appropriate terminals 30*a*, 30*b*, 30*c* and 30*d* using clamp 32*a*, 32*b*, 32*c* and 32*d* in the usual manner. Lightening arrester shunt 40 and clamp 36 are then installed using threaded bolt or screw 38. If desired, screw 38 is connected to a grounding strap and serves as the grounding terminal. Care should be taken to insure that portion 40*e* and 40*f* of the shunt 40 are not bent during installation and have the proper gap or spacing from socket terminals 30*a* and 30*c*, respectively. This gap is predetermined and maintained during installation by insuring that portions 40*e* and 40*f* are perpendicular to base 12. The watt-hour meter W is then operably installed to establish electrical connection by inserting the knife or bayonet connector into the socket terminals 30*a*, 30*b*, 30*c* and 30*d* respectively, until flange 18 is engaged. The flange securing clamp is then installed to hold watt-hour meter W with the base structure 10 and then sealed to prevent tampering with meter W. The mounting base apparatus A and watt-hour meter W are then ready for use as desired.

In the event of a voltage surge resulting from lightening or some other cause, the gaps will arc over and the shunt 40 will safely ground the excessive voltage. Once the voltage surge has passed or otherwise been eliminated, the protected meter W is automatically again ready for use without resetting the protective device.

The foregoing disclosure and description of the invention are illustrative and explanatory thereof, and various changes in the size, shape and materials, as well as in the details of the illustrated construction, may be made without departing from the spirit of the invention.

What is claimed is:

1. A mounting base apparatus adapted for mounting a watt-hour meter having a plurality of electrical terminals to electrically connect the watt-hour meter, said mounting base including:

a molded plastic base structure forming a partially enclosed cavity and having electrical insulating properties;

said base having a circular back connected with a forwardly extending tubular side wall to form the partially enclosed cavity, said tubular wall terminating in an external flange spaced from said back, said flange forming a substantially planar circular surface disposed substantially parallel with said circular back and having a concentric opening for operably receiving the watt-hour meter, said flange co-acting with a lock ring to receive the watt-hour meter with said base;

means for mounting said plastic base structure to a suitable support structure at a desired location;

a plurality of electrical terminals disposed in said cavity for receiving a corresponding plurality of blade terminals on the watt-hour meter to electrically connect the watt-hour meter;

an opening disposed in said base structure to enable passage of electrical conductor wires connected to said terminals;

an electrical safety conductor mounted with said base structure and located adjacent two of said terminals and gapped a sufficient distance from at least one of said terminals to prevent arcing for conducting electrical energy through said electrical conductor at substantially normal operating voltage of the meter while enabling arcing of electrical power to enable electrical power flow through said safety conductor at greater than substantially normal operating voltage to protect said watt-hour meter from electrical overloads.

2. The mounting base apparatus as set forth in claim 1, wherein:

said plurality of terminals including a pair of supply terminals connected to the supply of electrical power and a pair of output terminals connected to the electrical load network.

3. The mounting base apparatus as set forth in claim 1, wherein:

said molded base structure is formed of stabilized polyester having a 15% glass filler.

4. The mounting base apparatus of claim 1, wherein:

a second opening disposed in said base structure to enable passage of electrical conductor wires connected to said terminals.

5. The mounting base apparatus of claim 1, wherein:

said electrical safety conductor is electrically grounded.

6. The mounting base as set forth in claim 1, wherein:

said electrical safety conductor forming a base portion having oppositely extending arms, each arm forming a portion disposed a predetermined distance from one of said adjacent two of said electrical terminals so excessive electrical voltage will arc across the predetermined distance to protect the watt-hour meter.

* * * * *